US008564264B2

(12) United States Patent
Hallak

(10) Patent No.: US 8,564,264 B2
(45) Date of Patent: Oct. 22, 2013

(54) CURRENT CONTROL SYSTEM AND METHOD FOR CONTROLLING A CURRENT

(75) Inventor: Jalal Hallak, Vienna (AT)

(73) Assignee: Siemens Aktiengesellschaft, Munich (DE)

( * ) Notice: Subject to any disclaimer, the term of this patent is extended or adjusted under 35 U.S.C. 154(b) by 192 days.

(21) Appl. No.: 13/120,395

(22) PCT Filed: Jun. 23, 2009

(86) PCT No.: PCT/EP2009/057749
§ 371 (c)(1),
(2), (4) Date: Mar. 22, 2011

(87) PCT Pub. No.: WO2010/034532
PCT Pub. Date: Apr. 1, 2010

(65) Prior Publication Data

US 2011/0175447 A1 Jul. 21, 2011

(30) Foreign Application Priority Data

Sep. 24, 2008 (AT) ..... A1486/2008

(51) Int. Cl.
*G05F 1/00* (2006.01)

(52) U.S. Cl.
USPC ..... 323/282; 323/273

(58) Field of Classification Search
USPC ..... 323/266, 270–275, 280, 281, 284; 307/31
See application file for complete search history.

(56) References Cited

U.S. PATENT DOCUMENTS

| | | | | |
|---|---|---|---|---|
| 4,704,572 | A | 11/1987 | Melbert | |
| 5,734,259 | A | 3/1998 | Sisson et al. | |
| 5,929,617 | A | 7/1999 | Brokaw | |
| 6,177,783 | B1 * | 1/2001 | Donohue | 323/272 |
| 6,366,068 | B1 | 4/2002 | Morishita | |
| 6,900,624 | B2 * | 5/2005 | Abo | 323/284 |
| 2002/0057079 | A1 | 5/2002 | Horie | |
| 2006/0267562 | A1 | 11/2006 | Szepesi | |
| 2008/0116864 | A1 | 5/2008 | Goto et al. | |

FOREIGN PATENT DOCUMENTS

| | | | |
|---|---|---|---|
| CN | 1528040 | A | 9/2004 |
| CN | 1912791 | A | 2/2007 |
| DE | 33 41 345 | A1 | 5/1985 |
| JP | 8-30340 | A | 2/1996 |
| SU | 1529190 | | 12/1989 |
| WO | WO 02/082611 | A2 | 10/2002 |

* cited by examiner

*Primary Examiner* — Adolf Berhane
*Assistant Examiner* — Yemane Mehari
(74) *Attorney, Agent, or Firm* — Cozen O'Connor

(57) ABSTRACT

A current control system comprising at least one series arm including a linear series regulator for generating a manipulated variable signal, wherein the linear series regulator is connected to a semiconductor control element which is connected to a supply voltage referenced to a ground potential, and the semiconductor control element includes an output voltage at its output side relative to the ground potential. A reference signal fed to the series regulator, a current measurement signal, and the manipulated variable signal are referenced to the ground potential, where the manipulated variable signal is fed to a subtractor which subtracts the difference of the feed voltage minus the output voltage from the manipulated variable signal, and the generated output signal of the subtractor is fed to the semiconductor control element as a corrected manipulated variable signal.

11 Claims, 3 Drawing Sheets

CURRENT CONTROL SYSTEM AND METHOD FOR CONTROLLING A CURRENT

CROSS-REFERENCE TO RELATED APPLICATIONS

This is a U.S. national stage of International Application No. PCT/EP2009/057749, filed on 23 Jun. 2009. This patent application claims the priority of Austrian patent application A1486/2008 filed 24 Sep. 2008, the content of which application is incorporated herein by reference in its entirety.

BACKGROUND OF THE INVENTION

1. Field of the Invention

The invention relates to current regulators and, more particularly, to a current regulating system comprising at least one series branch containing a linear series regulator for forming a manipulated variable signal, where a series regulator is connected to a semiconductor control element, which is connected to a supply voltage referred to ground, and an output voltage referenced to ground at the series regulator on the output side. The invention also relates to a method for regulating a current.

2. Description of the Invention There are numerous electrical and electronic applications that make current regulation necessary. For example, power supplies are known that regulate the current to output a constant current to one or more connected loads.

In addition, electronic protective devices are known that are used to safeguard one or more load circuits connected to a power supply. If a fault (e.g., a short-circuit) occurs in a load circuit, the electronic protective device limits the current for a short time (e.g., a few milliseconds) by current regulation and then turns off. The other load circuits continue to be supplied from the power supply. Also when momentary excess currents occur, for instance, when a load is switched on, electronic protective devices limit the current to a defined value.

In such applications, which only provide current limiting or current regulation for a short time, simple linear series regulators are mostly used. Such series regulators control a semiconductor control element, which absorbs energy for a short period to keep the current through a connected, faulty load at a defined value. The schematic layout of a corresponding current regulating system is shown in FIG. 1. In this circuit, a series branch for regulating a current through a connected load is provided at a supply voltage.

A reference value or setpoint value for regulating the current, and a current measurement value are referenced to the output voltage, which drops across the connected load. The series regulator is supplied here from an auxiliary voltage, which likewise has the output voltage as the reference potential. The auxiliary voltage is used to generate a sufficiently high manipulated variable signal between a control terminal (gate) and an output terminal (source) of the semiconductor control element.

If, for example, a plurality of series branches are connected in parallel to a supply voltage, a separate auxiliary voltage must be provided for each series regulator because each auxiliary voltage generally has a different output voltage as the reference potential.

SUMMARY OF THE INVENTION

It is therefore an object of the invention to provide an improved current regulating system and a correspondingly improved method for current regulation.

These and other objects and advantages are achieved in accordance with the invention by a current regulating system and method in which a reference signal is supplied to a series regulator, a current measurement signal and the manipulated variable signal are referenced to ground, where the manipulated variable signal is supplied to a subtractor, which sums the output voltage and the manipulated variable signal and subtracts the supply voltage, and where the output signal from the subtractor that is formed in this manner is supplied to a semiconductor control element as a corrected manipulated variable signal. The current regulating system is thereby prevented from starting oscillation caused by impedances in the control path. The frequency of such an oscillation would lie above the cut-off frequency of the series regulator. The manipulated variable signal is corrected almost immediately by the subtractor because of a simple calculation operation. As a result, the corrected manipulated variable signal to control the semiconductor control element prevents oscillation of the control path because the voltage between the control terminal and the output terminal of the semiconductor control element is substantially unchanged until the series regulator defines a changed manipulated variable signal.

In an embodiment, the series regulator is connected to an auxiliary voltage which is referenced to ground. Here, it is advantageous if the auxiliary voltage is present at an auxiliary supply that is arranged in series with the supply voltage. The supply voltage is thereby also used to supply the series regulator to achieve a higher level than the supply voltage for the manipulated variable signal. This higher level is required for controlling the semiconductor control element.

In another embodiment, a current amplifier is advantageously provided to form the current measurement signal, where the current amplifier is connected to the auxiliary voltage and is connected to measurement points before and after a shunt resistor that is connected in series with the semiconductor control element. A shunt resistor creates a simple facility for making an accurate and highly responsive current measurement that is unaffected by external factors such as an ambient temperature.

The semiconductor control element changes its forward resistance as a function of the manipulated variable signal applied to the control terminal. Here, it is advantageous to use simple components, such as common bipolar transistors, field effect transistors (e.g. MOSFETs) or insulated gate bipolar transistors (IGBTs).

In a particularly advantageous embodiment, a plurality of series branches are provided that are connected to a supply voltage and have a common auxiliary voltage for supplying the respective series regulators. The fact that the current measurement signals and reference signals are referenced in common to ground obviates the need to supply each series regulator with a separate auxiliary voltage.

A method in accordance with the invention for regulating a current provides for a series regulator to be supplied with a current measurement signal and a reference signal, and a manipulated variable is formed as a function of the difference between these two signals, where the current to be regulated is controlled by a resistance change of a semiconductor control element arranged between a supply voltage and an output voltage. In addition, the reference signal and the current measurement signal are referenced to ground, and the manipulated variable is corrected by a subtractor so that the difference of the supply voltage minus the output voltage is subtracted from the manipulated variable.

Here, the corrected manipulated variable is formed almost immediately, thereby maintaining the stability of the control circuit even with a rapid change in the output voltage or supply voltage if, as a result of the current measurement signal and the reference signal being referenced to ground, positive feedback from a line impedance occurs in the series branch.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described below by way of example with reference to the attached figures, in which.

DETAILED DESCRIPTION OF THE PREFERRED EMBODIMENTS

Figure 1:
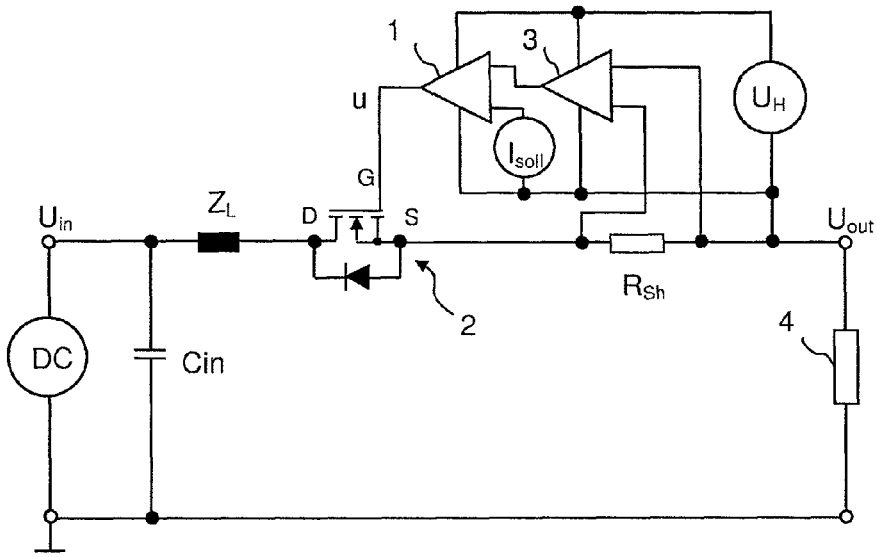
Fig. 1 Prior Art
FIG. 1 is a schematic block diagram showing a current regulating system having a series regulator in accordance with the prior art.

In the conventional current regulating system shown in FIG. 1, a direct current source DC is provided, which is connected by one terminal to ground, and at the other terminal is a supply voltage $U_{in}$. A capacitor Cin for voltage smoothing is arranged in parallel with the direct current source.

A semiconductor control element 2 is connected to the supply voltage $U_{in}$, the line between the direct current source DC and the semiconductor control element 2 having an impedance $Z_L$. The semiconductor control element 2, for example, comprises an enhancement-mode n-channel MOSFET having a gate terminal G, a drain terminal D and a source terminal S. Here, the source terminal S is connected to the drain terminal D by a parasitic diode. Moreover, the drain terminal is connected to the supply voltage $U_{in}$.

A manipulated variable signal from a linear regulator 1 is present at the gate terminal G. The source terminal S is connected to an output, at which an output voltage $U_{out}$ exists and to which is connected a terminal of a load 4. A second terminal of the load 4 is connected to the ground. A shunt resistor $R_{Sh}$ for current measurement is arranged between the source terminal S and the output.

Before and after the shunt resistor $R_{Sh}$, contact points are connected to the inputs of a current amplifier 3. The current amplifier 3 outputs a current measurement signal, which is supplied to the series regulator 1.

The current amplifier 3 and the series regulator 1 are supplied by an auxiliary supply $U_H$, which is referenced to the output voltage $U_{out}$.

The linear regulator 1 is additionally supplied with a reference signal for defining a current setpoint value $I_{soll}$, where the reference signal is likewise referenced to the output voltage $U_{out}$.

The semiconductor switching element 2 is normally conducting in fault-free operation, and therefore the output voltage $U_{out}$ equals approximately the supply voltage $U_{in}$, assuming negligible component losses and line losses. In this state, the manipulated variable signal lies below the threshold voltage of the semiconductor switching element 2.

If, as a result of a fault, the current rises above the defined current setpoint value $I_{soll}$, the regulator will start to operate. The manipulated variable signal rises above the threshold value of the semiconductor switching element 2, and therefore the forward resistance from the drain terminal to the source terminal of the semiconductor switching element 2 increases. It is self-evident that the maximum time that such current limiting is allowed to last depends on the surrounding thermal circumstances. Usually, it is possible to regulate a current to a defined setpoint value in this way for several seconds before the semiconductor switching element 2 suffers any damage.

In order to supply, for example, a plurality of series branches arranged in parallel by an auxiliary voltage, it is desirable that the auxiliary voltage and the individual reference signals and current measurement signals are referenced to a common ground. Although this achieves the desired independence from the output voltages of the individual series branches, which are generally of different value, a change in the output voltage in a series branch will cause positive feedback in the control loop because of the line impedance $Z_L$.

If, for instance, when there is a step-change in load, the output voltage or the voltage at the source terminal of the corresponding semiconductor component falls, this necessarily causes the voltage between the gate terminal and the source terminal to rise, because the control-value signal referenced to ground does not fall synchronously with the output voltage as a result of the line impedance $Z_L$. This positive feedback results in an unstable control circuit and causes permanent current oscillation.

Figure 2:
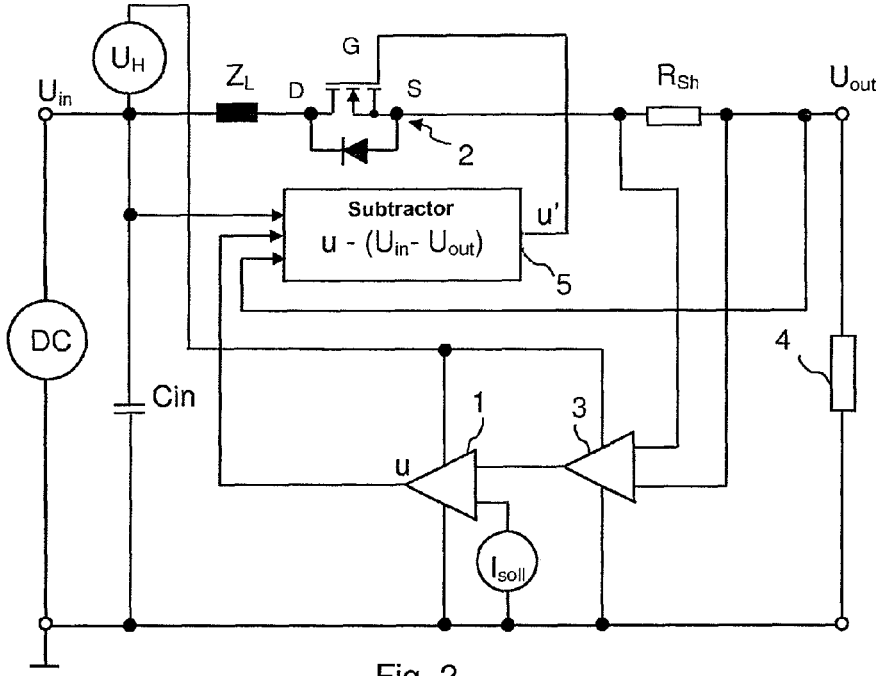
FIG. 2 is a schematic diagram showing a current regulating system having manipulated variable correction in accordance with an embodiment of the invention.

In accordance with an embodiment of the invention, a manipulated variable correction is performed to eliminate the effect of the positive feedback in the control circuit. A suitable arrangement is shown in FIG. 2.

The basic circuit comprises a series circuit, where a load 4 is connected to a supply voltage $U_{in}$ by an auxiliary switch element 2. The circuit is closed by a ground that is the common reference potential for the supply voltage $U_{in}$ and the output voltage $U_{out}$ that is dropped across the load 4.

The auxiliary switch element 2 comprises a MOSFET, for example, as shown in FIG. 1, where the drain terminal D is connected to the supply voltage $U_{in}$ and the source terminal S is connected to the output, at which the output voltage $U_{out}$ exists. A shunt resistor $R_{Sh}$ is arranged here between the source terminal S and the output. The contact points before and after the shunt resistor are connected to the inputs of a current amplifier 3. The current amplifier 3, which is connected to the ground, is supplied with an auxiliary voltage, which exists at an auxiliary supply $U_H$ that is arranged in series with the supply voltage. Hence, the current measurement signal at the output of the current amplifier 3, similarly to the auxiliary voltage, is referenced to ground as is the common reference potential of the supply voltage $U_{in}$ and the common reference potential of the output voltage drop $U_{out}$ across the load 4.

The current measurement signal and a reference signal are input to a series regulator 1, which is supplied, similarly to the current amplifier 3, by the auxiliary voltage. The reference signal is referenced, much like the current measurement signal, to ground, and defines the current setpoint value $I_{soll}$.

Therefore, at the output of the series regulator 1 there exists a manipulated variable signal u, which is referenced to ground and is supplied to a subtractor 5. The subtractor 5 is also connected to the supply voltage $U_{in}$ and to the output voltage $U_{out}$, and generates a corrected manipulated variable signal u' in accordance with the following relationship:

$$u'=u-(U_{in}-U_{out})$$

In accordance with the invention, this corrected manipulated variable signal u' is applied to the gate terminal G of the semiconductor control element 2.

The subtractor 5 is advantageously configured as a simple analog circuit, so that the manipulated variable signal u is corrected almost immediately, i.e., as soon as a change occurs in the output voltage $U_{out}$ or in the supply voltage $U_{in}$. In any event, the correction is performed many times faster than an adjustment of the manipulated variable signal u by the series regulator 1.

The positive feedback from the impedance $Z_L$ is thus avoided by the immediate correction of the manipulated variable signal u. This correction equals the difference, caused by the impedance $Z_L$, of the supply voltage $D_{in}$ minus the output voltage $U_{out}$, whereby the voltage between the gate terminal and the source terminal of the semiconductor control element 2 is substantially unchanged until the series regulator 1 defines a changed manipulated variable signal u. The control circuit is hence stable and no current oscillation occurs.

Figure 3:
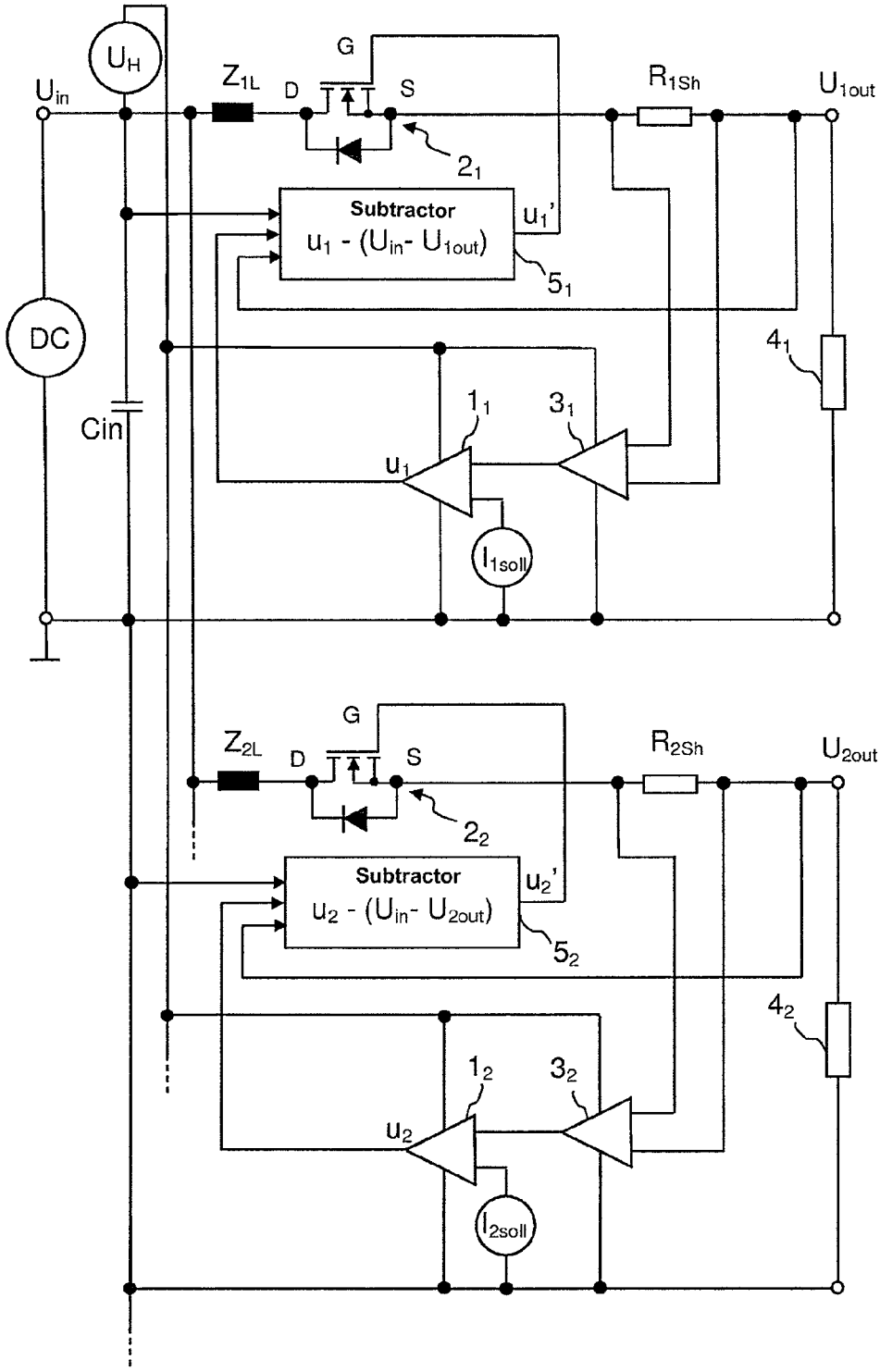
FIG. 3 is a schematic diagram showing a current regulating system having two series branches in accordance with an embodiment of the invention.

FIG. 3 is a schematic block diagram of two series branches having different output voltages $U_{1out}$, $U_{2out}$. The series circuits are supplied by a common supply voltage $D_{in}$, which is connected in series with an auxiliary voltage $U_H$. Each series circuit comprises a separate semiconductor control element $\mathbf{2}_1$ and $\mathbf{2}_2$ respectively, which limits the current to a respective defined current setpoint value $I_{1soll}$ and $I_{2soll}$ in the event of a short-circuit of the load $\mathbf{4}_1$ or $\mathbf{4}_2$ connected to the respective circuit or in the event of a brief overload. Each series branch comprises a separate respective shunt resistor $R_{1Sh}$ and $R_{2Sh}$ for the purpose of current measurement.

Each semiconductor control element $\mathbf{2}_1$ and $\mathbf{2}_2$ is controlled by a respective corrected manipulated variable signal $u_1'$ and $u_2'$ which exists at the output of a respective subtractor $\mathbf{5}_1$ or $\mathbf{5}_2$. The respective subtractor $\mathbf{5}_1$ or $\mathbf{5}_2$ corrects the respective manipulated variable signal $u_1$ and $u_2$ that is defined by a respective series regulator $\mathbf{1}_1$ or $\mathbf{1}_2$ according to the respective impedance $Z_{1L}$ or $Z_{2L}$ that arises in the series branch.

Due to all the current measurement signals, reference signals and manipulated variable signals $u_1$, $u_2$ being referenced to a common ground, given a plurality of series branches connected in parallel, there is now only a single auxiliary voltage required, to which all the series regulators $\mathbf{1}_1$, $\mathbf{1}_2$ and current amplifiers $\mathbf{3}_1$, $\mathbf{3}_2$ are connected. Here, it is self-evident that more than the two series branches shown in FIG. 3 can be connected in parallel in this manner.

Figure 4:
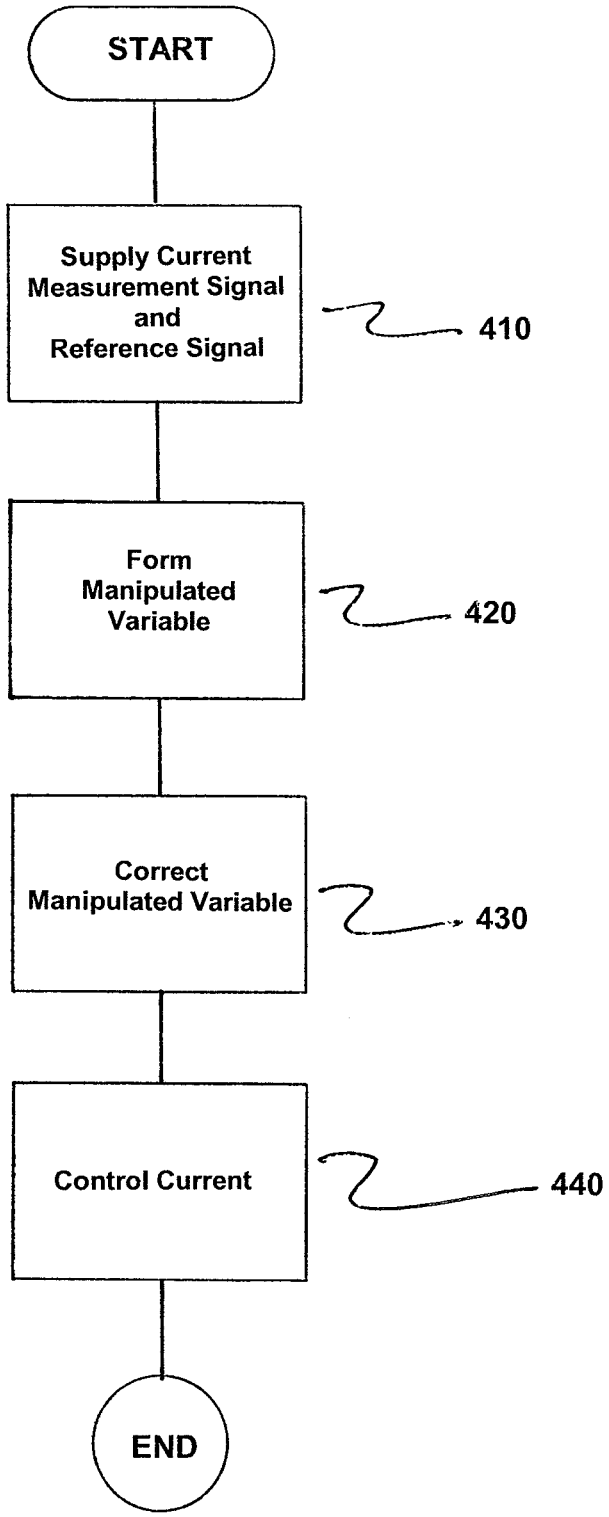
FIG. 4 is a flow chart of the method in accordance with an embodiment of the invention.

FIG. 4 is a flow chart of a method for regulating a current. The method comprises supplying a linear series regulator with a current measurement signal and a reference signal, as indicated in step 410. Here, the reference signal and the current measurement signal are referenced to ground. A manipulated variable is formed as a function of a difference between the current measurement signal and the reference signal, as indicated in step 420. The manipulated variable is corrected using a subtractor to subtract a difference of the supply voltage minus the output voltage from the manipulated variable to form a corrected manipulated variable, as indicated in step 430. A current to be regulated is controlled by a resistance change of a semiconductor control element arranged between a supply voltage and an output voltage based on the corrected manipulated variable, as indicated in step 440.

Thus, while there are shown, described and pointed out fundamental novel features of the invention as applied to preferred embodiments thereof, it will be understood that various omissions and substitutions and changes in the form and details of the illustrated apparatus, and in its operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice.

The invention claimed is:

1. A current regulating system comprising:

at least one series branch having a linear series regulator for forming a manipulated variable signal;

a semiconductor control element connected to the linear series regulator, the semiconductor control element being connected to a supply voltage referenced to ground, and an output voltage referenced to ground existing at an output side of the series regulator; and a subtractor which receives the manipulated variable signal, the supply voltage and the output voltage, said subtractor subtracting a difference of the supply voltage minus the output voltage from the manipulated variable signal;

wherein a reference signal supplied to the linear series regulator, a current measurement signal and the manipulated variable signal are referenced to ground, the manipulated variable signal is supplied to form an output signal; and wherein an output signal from the subtractor is supplied to the semiconductor control element as a corrected manipulated variable signal.

2. The current regulating system as claimed in claim 1, further comprising:

an auxiliary voltage referenced to ground, the linear series regulator being connected to the auxiliary voltage.

3. The current regulating system as claimed in claim 2, further comprising:

an auxiliary supply arranged in series with the supply voltage, the auxiliary voltage referenced to ground being present at the auxiliary supply.

4. The current regulating system as claimed in claim 2, further comprising:

a shunt resistor connected in series with the semiconductor control element; and a current amplifier for forming the current measurement signal, the current amplifier being connected to the auxiliary voltage and connected to measurement points before and after the shunt resistor.

5. The current regulating system as claimed in claim 3, further comprising:

a shunt resistor connected in series with the semiconductor control element; and a current amplifier for forming the current measurement signal, the current amplifier being connected to the auxiliary voltage and connected to measurement points before and after the shunt resistor.

6. The current regulating system as claimed in claim 1, wherein the semiconductor control element comprises one of a bipolar transistor, a field effect transistor and an insulated gate bipolar transistor.

7. The current regulating system as claimed in claim 2, further comprising:

a plurality of series branches connected to the supply voltage, each of the plurality of series branches having a common auxiliary voltage for supplying a respective linear series regulator.

8. The current regulating system as claimed in claim 3, further comprising:

a plurality of series branches connected to the supply voltage, each of the plurality of series branches having a common auxiliary voltage for supplying a respective linear series regulator.

9. The current regulating system as claimed in claim 4, further comprising:

a plurality of series branches connected to the supply voltage, each of the plurality of series branches having a common auxiliary voltage for supplying a respective linear series regulator.

10. The current regulating system as claimed in claim 6, further comprising:

a plurality of series branches connected to the supply voltage, each of the plurality of series branches having a common auxiliary voltage for supplying a respective linear series regulator.

11. A method for regulating a current, comprising:

supplying a linear series regulator with a current measurement signal and a reference signal, the reference signal and the current measurement signal being referenced to ground;

forming a manipulated variable as a function of a difference between the current measurement signal and the reference signal;

correcting the manipulated variable using a subtractor which receives the manipulated variable signal, a supply voltage and an output voltage, said subtractor subtracting a difference of the supply voltage minus the output voltage from the manipulated variable to form a corrected manipulated variable; and controlling a current to be regulated by a resistance change of a semiconductor control element arranged between the supply voltage and the output voltage based on the corrected manipulated variable.

* * * * *